US005865984A

United States Patent [19]

Corbin, Jr. et al.

[11] Patent Number: 5,865,984

[45] Date of Patent: Feb. 2, 1999

[54] ELECTROCHEMICAL ETCHING APPARATUS AND METHOD FOR SPIRALLY ETCHING A WORKPIECE

[75] Inventors: William E. Corbin, Jr., Newburgh; Madhav Datta, Yorktown Heights, both of N.Y.; Thomas E. Dinan, San Jose, Calif.; Frederick W. Kern, Colchester, Vt.

[73] Assignee: International Business Machines Corporation, Armonk, N.Y.

[21] Appl. No.: 885,608

[22] Filed: Jun. 30, 1997

[51] Int. Cl.[6] ..... C25F 3/02; C25F 7/00

[52] U.S. Cl. ..... 205/670; 205/686; 205/672; 204/212; 204/224 M

[58] Field of Search ..... 204/224 M, 297 R, 204/212; 205/672, 670, 668, 686

[56] References Cited

U.S. PATENT DOCUMENTS

| | | | |
|---|---|---|---|
| 2,741,594 | 4/1956 | Bowersett | 204/212 |
| 4,486,279 | 12/1984 | Fromson et al. | 204/212 |
| 4,599,154 | 7/1986 | Bender et al. | 205/670 X |
| 4,846,944 | 7/1989 | Adachi | 205/672 X |
| 5,284,554 | 2/1994 | Datta et al. | 204/129.5 |
| 5,486,282 | 1/1996 | Datta et al. | 205/123 |
| 5,536,388 | 7/1996 | Dinan et al. | 205/670 |
| 5,567,300 | 10/1996 | Datta et al. | 205/652 |
| 5,567,304 | 10/1996 | Datta et al. | 205/666 |

*Primary Examiner*—Donald R. Valentine
*Attorney, Agent, or Firm*—Ira D. Blecker

[57] ABSTRACT

Disclosed is an electrochemical etching apparatus including a fixture for holding a workpiece; a nozzle, positioned opposite the fixture and facing the workpiece, for impinging an etchant onto the workpiece; and an electrode for applying a voltage between the electrode and the workpiece; wherein, in operation, one of the fixture and nozzle are rotated and the nozzle is moved radially outwardly so that the workpiece is spirally etched. Also disclosed is a method of spirally etching a workpiece.

32 Claims, 5 Drawing Sheets

ELECTROCHEMICAL ETCHING APPARATUS AND METHOD FOR SPIRALLY ETCHING A WORKPIECE

BACKGROUND OF THE INVENTION

The present invention is directed to electrochemically etching and, more particularly, is directed to electrochemically etching a workpiece from the center outwardly in a spiral pattern.

Electrochemical etching has many industrial applications wherein a conductive metal is etched from the surface of a workpiece. The present inventors have proposed a new apparatus and method for electrochemical etching which has wide industrial application. The present invention, however, has particular application to the electrochemical etching of semiconductor wafers and so the present invention will only be discussed in reference to semiconductor wafers, although it should be understood that the present invention has wider industrial application.

Electroetching involves metal removal from a workpiece which is made an anode in an electrolytic cell. The cell contains a counter electrode (cathode) at an appropriate position. In the microelectronics industry, electroetching is used for through-mask patterning and for removal of continuous thin film of conducting metals, such as seed layers from the surface of a semiconductor wafer. Different types of electroetching apparatus are described in the literature that use a variety of electrolyte flow systems ranging from non-agitated to impinging jets. For electroetching of large wafers, such as 200 mm, the electroetching systems pose problems of high power requirement and tremendous edge effects that lead to the loss of electrical connection to the metal film.

In order to alleviate the above problems, Datta et al. U.S. Pat. No. 5,284,554, and U.S. Pat. No. 5,486,282, the disclosures of which are incorporated by reference herein, proposed to treat only a small portion of the wafer at a given time by using a multinozzle cathode assembly of small width which delivers the electrolyte to a part of the wafer that faces the cathode assembly. During electroetching, the multinozzle assembly is slowly scanned from one end of the wafer to the other end. The nozzle movement is adjusted to match the etching rate of film so that the wafer etching is completed in one pass. Additional Patents reflecting further improvements to the above work include Dinan et al. U.S. Pat. No. 5,536,388 and Datta et al. U.S. Pat. No. 5,567,304, the disclosures of which are incorporated by reference herein.

Notwithstanding the prior art solutions to the problem, there remains a need to improve electrochemical etching. The present inventors have proposed to change the way in which the electrolyte contacts the wafer surface. Rather than using a linear trough for the electrolyte and contacting the wafer across a chord with dependence on an ever-decreasing number of contact points, the present inventors have proposed an apparatus and method with an annular contact path so that this dependence on an ever-decreasing number of contact points is eliminated.

Thus, a purpose of the present invention is to have an apparatus and method for electrochemical etching which does not use a linear trough for the electrolyte.

It is another purpose of the present invention to have an apparatus and method for electrochemical etching which does not depend on an ever-decreasing number of contact points.

These and other purposes of the present invention will become more apparent after referring to the following description considered in conjunction with the accompanying drawings.

BRIEF SUMMARY OF THE INVENTION

The objects and advantages of the present invention have been achieved by providing, according to a first aspect of the invention an electrochemical etching apparatus comprising:

a fixture for holding a workpiece;

a nozzle, positioned opposite the fixture and facing the workpiece, for impinging an etchant onto the workpiece; and an electrode for applying a voltage between the electrode and the workpiece;

wherein, in operation, one of the fixture and nozzle are rotated and the nozzle is moved radially outwardly from a position opposite the center of the workpiece while simultaneously (i) causing the etchant to impinge upon the workpiece and (ii) applying a voltage between the electrode and the workpiece to thereby cause electrochemical etching of the workpiece.

According to a second aspect of the invention, there is provided a method of electrochemically etching a workpiece with an apparatus comprising a fixture for holding a workpiece, a nozzle for supplying an etchant and an electrode for applying a voltage between the electrode and the workpiece, the method comprising the steps of:

rotating one of the workpiece and nozzle;

applying a voltage between the electrode and the workpiece; and moving the nozzle radially outwardly from a position opposite the center of the workpiece while simultaneously causing the etchant to impinge upon the rotated workpiece to thereby cause electrochemical etching of the workpiece.

DETAILED DESCRIPTION OF THE INVENTION

Figure 1:
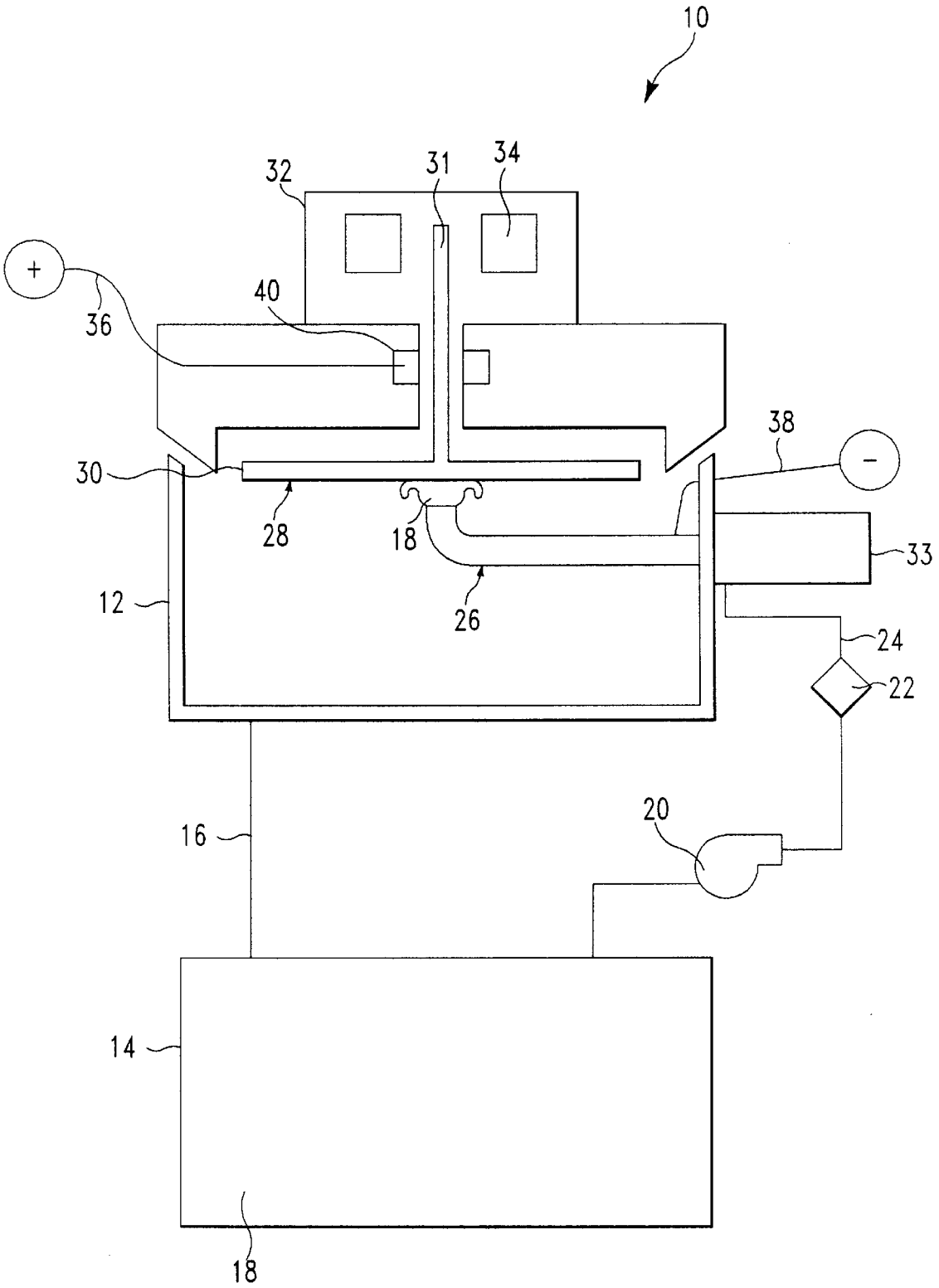
FIG. 1 is a schematical view of the invention along with associated apparatus.
Figure 7A:
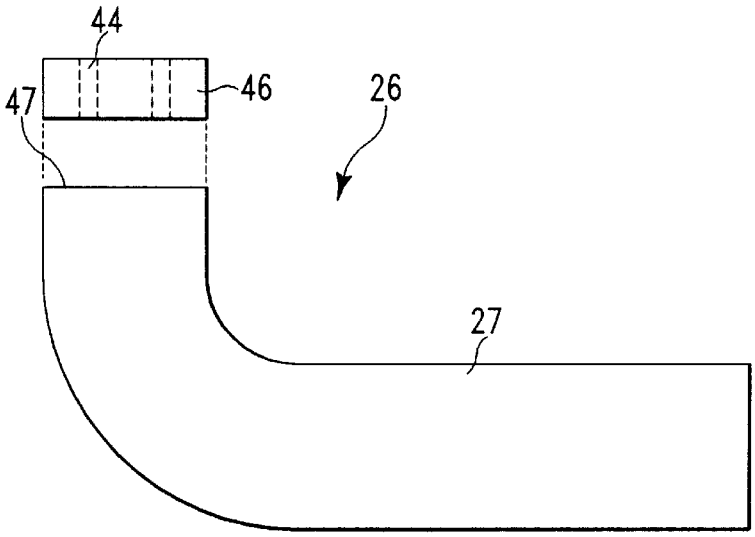
FIG. 7A is an exploded view of the nozzle assembly.
Figure 7B:
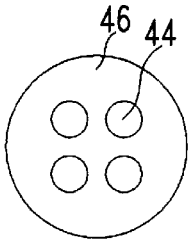
FIG. 7B is a plan view of a first embodiment of the face plate and FIG. 7C is a plan view of a second embodiment of the face plate.

Referring to the Figures in more detail, and particularly referring to FIG. 1, there is shown the electrochemical etching apparatus according to the present invention in its intended environment. Electrochemical etching system 10 consists of tank 12 connected to fluid reservoir 14 by conduit 16. Etchant 18 within fluid reservoir 14 is pumped by pump 20 through conduit 24 and filter 22 to nozzle assembly 26 where it is impinged upon wafer 28. It may be desirable to have a separate pump and filter (not shown) dedicated to filtering etchant 18 in tank 14, in which case filter 22 may be dispensed with. Nozzle assembly 26 is suitably supported within tank 12 and is adapted to move either linearly or both linearly and rotationally, as will be described in more detail hereafter. Referring now to FIGS. 7A and 7B, nozzle assembly 26 comprises nozzle tube 27 having an orifice 47 to which is attached face plate 46. The face plate 46 has at least one perforation or nozzle 44 to allow the passage of etchant 18. Perforation or nozzle 44 is hereafter just called the nozzle 44. Referring again to FIG. 1, wafer 28 is mounted on fixture 30 which has shaft 31 mounted within head 32 and motor 34. In one embodiment of the invention, motor 34 causes shaft 31 to rotate. Also contained within head 32 is rotating electrical contact 40 which makes electrical contact with shaft 31. Wires 36 and 38 lead to the positive and negative poles, respectively, of a suitable electrical source (not shown). Wafer 28 makes electrical contact with fixture 30 through contact clips (not shown) which in turn makes electrical contact with rotating electrical contact 40. As thus configured, wafer 28 becomes the anode during electroetching of the wafer 28.

Figure 7C:
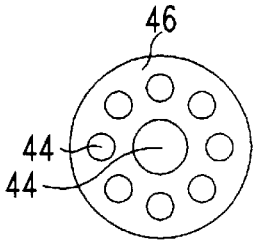

Due to more current at the edges than at the center of the face plate 46, strips of unetched material may be left on the wafer 28. Therefore, it is preferred that the face plate 46 have nozzles 44 with varying sizes to compensate for the edge effects. One such embodiment is shown in FIG. 7C where bigger nozzles 44 are at the center of the face plate 46 while smaller nozzles 44 are at the edge.

Figure 2:
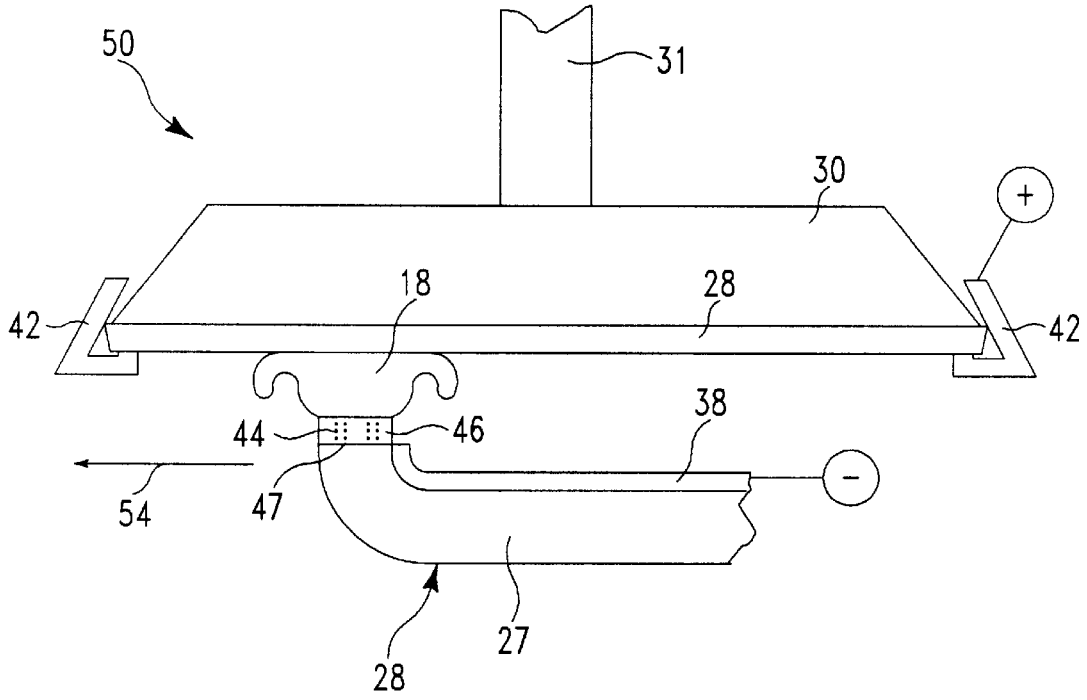
FIG. 2 is a schematical view of a first embodiment of the present invention showing movement of the nozzle with respect to the workpiece.

Referring now to FIG. 2, there is disclosed, according to the present invention, a more detailed view of the electrochemical etching apparatus, generally indicated by 50. The electrochemical etching apparatus 50 includes the fixture 30 for holding the semiconductor wafer 28. A plurality of contact clips 42 are provided to maintain contact between the wafer 28 and the positive pole of the electrical source. The nozzle 44 is positioned opposite the fixture 30 and faces the wafer 28. As noted earlier, nozzle 44 sprays or impinges an etchant 18 onto the wafer 28. The nozzle 44 may be circular, oval or rectangular in cross-section. As shown in FIG. 7B, the nozzle 44 is circular in cross-section. The nozzle 44 has a diameter or width of about 3 mm or less while the nozzle orifice 47 has a diameter or width of about 25 mm, although other dimensions may be suitable for different applications.

Also provided in the electrochemical etching apparatus 50 according to the present invention is an electrode that applies a voltage between the electrode and the wafer 28. For better control of the etching process, it is preferred that the electrode be located near, or proximate, to the fixture 30. As shown in FIG. 2, face plate 46 also serves as the electrode. Face plate/electrode 46 is connected by wire 38 to the negative pole of the electrical source. The spacing between the face plate/electrode 46 and the wafer 28 is on the order of about 0.3 to 4 millimeters.

The face plate/electrode 46 is made from a metal that is resistant to the electrochemical etching and to the etchant. For example, suitable metals for the face plate/electrode 46 are stainless steel or a noble metal.

Wafer 28 may be attached to fixture 30 by any means known to those skilled in the art. For example, contact clips 42 may serve to hold wafer 28 to the fixture 30 as well as provide electrical contact. Alternatively, fixture 30 may be a vacuum chuck and contact clips 42 would merely provide electrical contact to the wafer 28.

Figure 4:
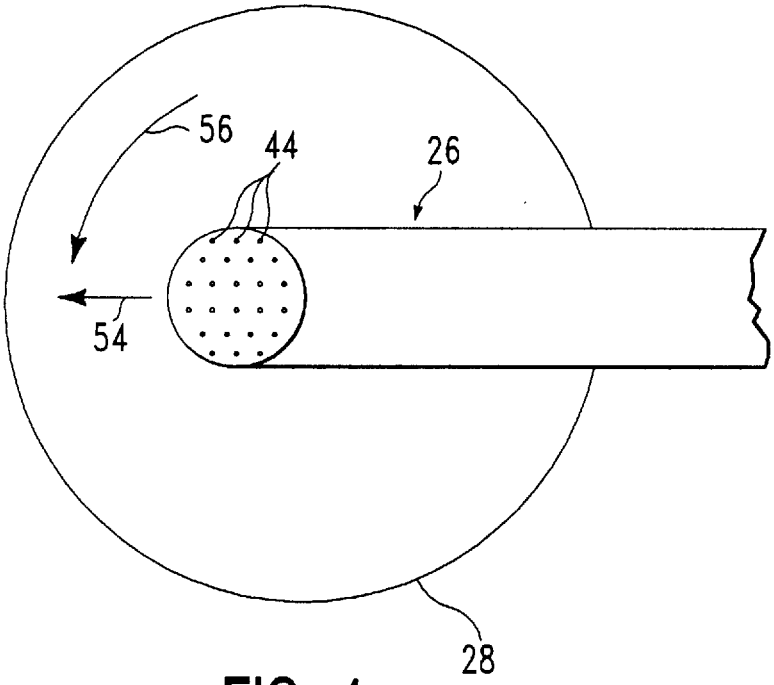
FIG. 4 is a schematical view showing the relative movement between the workpiece and the nozzle.
Figure 5:
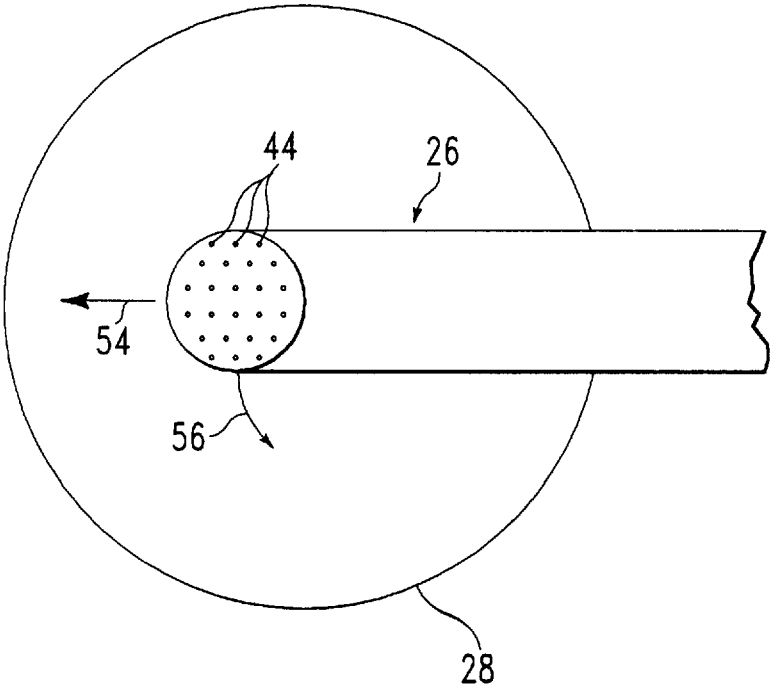
FIG. 5 is a schematical view similar to FIG. 4 but showing an alternative form of relative movement between the workpiece and the nozzle.

In operation, one of the fixture 30 (including wafer 28) and the nozzle 44 are rotated. Referring now to FIGS. 4 and 5, it can be seen that the wafer 28 may be rotated 56 while the nozzle 44 is moved linearly 54, as shown in FIG. 4, or the nozzle 44 may be articulated so that the nozzle 44 moves linearly 54 while simultaneously moving in a circular pattern 56, as shown in FIG. 5.

Figure 6:
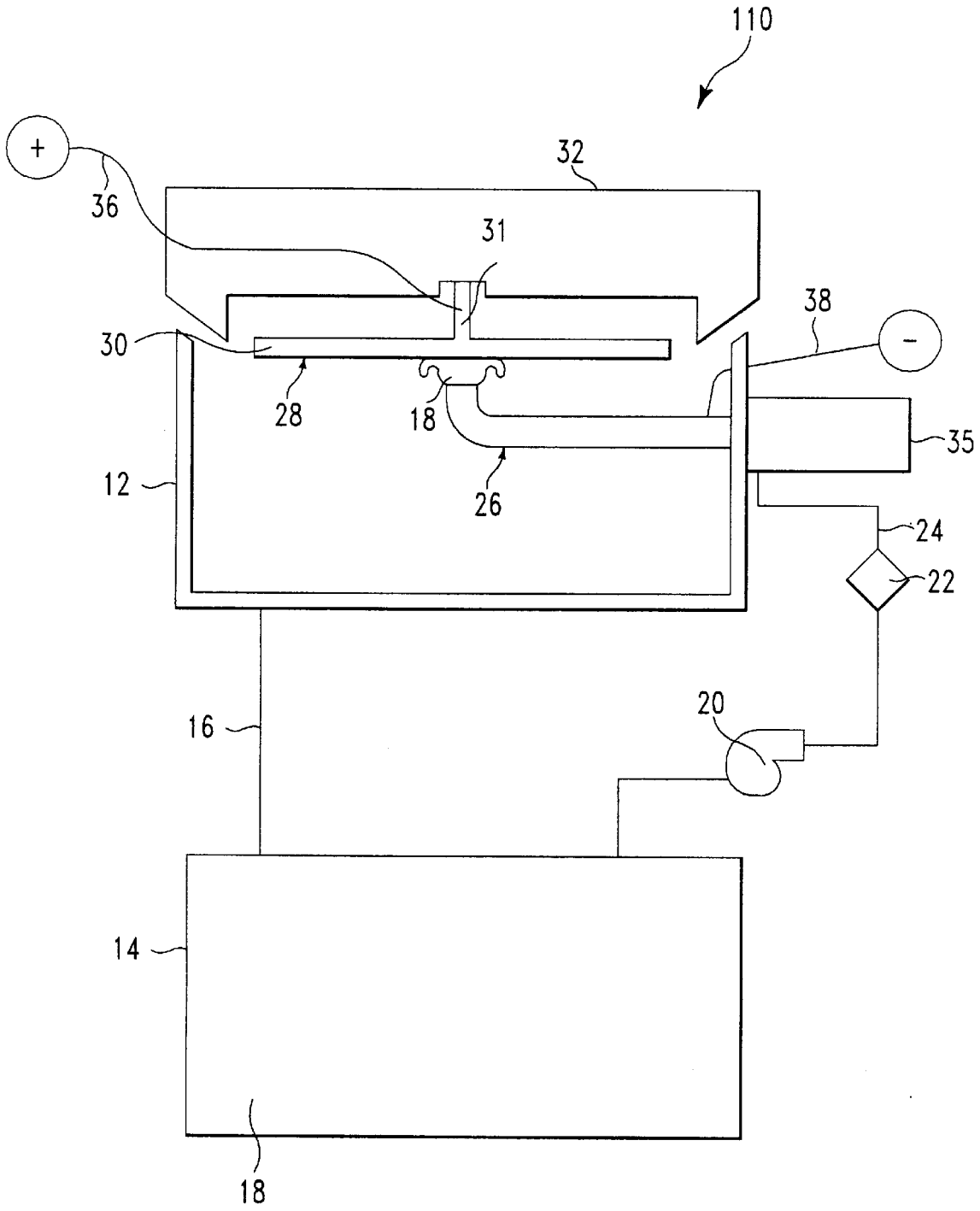
FIG. 6 is a schematical view similar to FIG. 1 except that the wafer is held stationary while the nozzle articulates.

The motion shown in FIG. 4 may be achieved by rotating the wafer 28 by motor 34 and linearly moving the nozzle assembly 26 and nozzle 44 by linear motor 33. The motion shown in FIG. 5 may be achieved by the modified apparatus 110 shown in FIG. 6. Since the wafer 28 is not rotated in FIG. 6, shaft 31 need only be suitably held within head 32; motor 34 shown in FIG. 1 may be dispensed with. Now, nozzle assembly 26 and nozzle 44 are rotated while simultaneously moving linearly across the wafer 28 by stepper/resolver motors 35.

The speed of rotation is dependent on the etching rate desired. Spin rates of 0.1 to 30 revolutions per minute, preferably 1 to 10 revolutions per minute are considered within the scope of the present invention. The nozzle 44 is placed opposite the center of wafer 28. At this point, the etchant 18 is caused to impinge upon the wafer 28. Simultaneously, a voltage (DC or pulsating) is applied between the wafer 28 and the electrode (46 or 72) to give a current in the range of 0.5 to 5 amps. The nozzle 44 is then caused to move outwardly 54 toward the perimeter of the wafer. Electrochemical etching thus proceeds from the center of the wafer 28 outwardly to the periphery of the wafer 28. In any given case, limited experimentation (based on material, thickness and etchant) would be desirable to optimize rotation and nozzle traversal so that etching over each area of the wafer is constant per unit of time.

As opposed to the prior art method of electrochemical etching with a linear trough, electrochemical etching according to the present invention, due to the combination of the rotational and linear movements of the fixture 30 (including the wafer 28) and the nozzle, proceeds nonlinearly in a spiral pattern. An advantage of the present invention is that there will always be an annular contact path connecting all of the contact clips 42 with the active etch area throughout the etching process. Thus, there will be no part of the wafer 28 which is unetched because of loss of contact with the contact clips.

As noted above, the speed of rotation of the fixture 30 (including the wafer 28) or the nozzle 44 is dependent on the desired etch rate. Similarly, the rate at which the nozzle 44 traverses the radius of the wafer 28 will also affect the etching rate. A typical rate of linear movement of the nozzle would be 0.5 to 3 millimeters per second. A typical flow rate for the etchant is about 0.25 to 3 liters per minute.

Figure 8A:
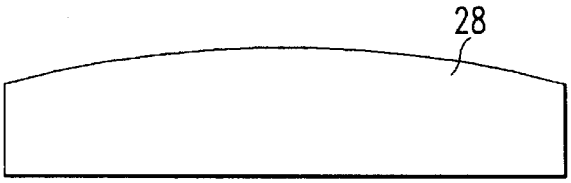
FIGS. 8A and 8B are examples of variable surface profiles of a wafer that can be obtained with the present invention.
Figure 8B:
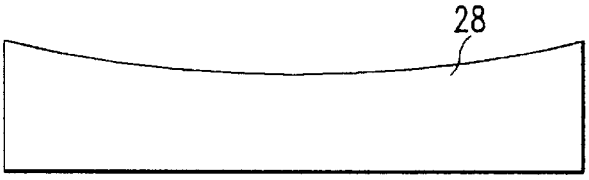

A further advantage of the present invention is that the etching rate may be varied across the surface of the wafer 28 by varying the relative movement of the wafer 28 and nozzle 44 and/or the voltage as the nozzle 44 traverses the surface of the wafer 28. Thus, the surface profile of the wafer 28 may be tailored to a particular situation. Two examples of surface profiles (exaggerated for purposes of illustration) that can be obtained are shown in FIGS. 8A and 8B where FIG. 8A is a convex surface profile and FIG. 8B is a concave surface profile.

As shown in FIG. 2, the fixture 30 and wafer 28 face downwardly and the nozzle 44 is oriented vertically upwardly. It is also within the scope of the invention to have the fixture 30 and wafer 28 face upwardly and the nozzle 44 oriented vertically downwardly or, alternatively, the fixture 30 and wafer 28 may be oriented so that they face horizontally while the nozzle 44 is oriented horizontally.

Figure 3:
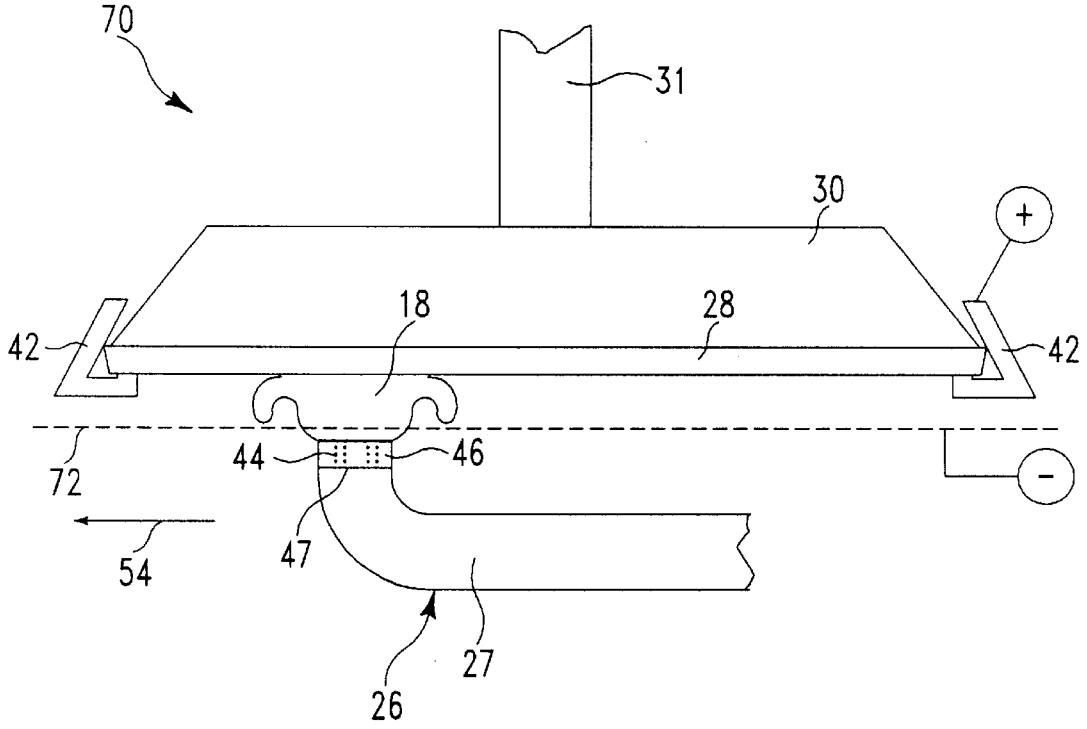
FIG. 3 is a schematical view similar to FIG. 1 showing a second embodiment of the invention.

Referring now to FIG. 3, a second embodiment of the invention is disclosed. The electrochemical etching apparatus 70 shown in FIG. 3 is similar to the electrochemical etching apparatus 50 shown in FIG. 2 except that the electrode differs. As shown in FIG. 3, the electrode 72 is a fixed metal screen which may be made of any suitable material, such as stainless steel or a noble metal. The electrode 72 is located parallel to the wafer 28 and is about the same size as the wafer 28. The etchant 18 passes through the electrode 72 to impinge on the wafer 28. The electrode 72 serves to pass current from the etchant 18 to the wafer 28. The nozzle orifice 47 may be reduced in size to less than 25 mm to reduce current flow, if desired, which should lead to longer life of the contact clips 42. Except for the different electrodes, the method of operation of electrochemical etching apparatus 70 is identical to that of electrochemical etching apparatus 50 as discussed above.

It will be apparent to those skilled in the art having regard to this disclosure that other modifications of this invention beyond those embodiments specifically described here may be made without departing from the spirit of the invention. Accordingly, such modifications are considered within the scope of the invention as limited solely by the appended claims.

What is claimed is:

1. An electrochemical etching apparatus comprising:

a fixture for holding a workpiece;

means for rotating the fixture;

a nozzle, adapted to be positioned opposite the fixture and facing the workpiece when present and adapted for impinging an etchant onto the workpiece;

means for radially moving the nozzle; and an electrode for applying a voltage to the workpiece;

wherein, in operation, the fixture is rotated while the nozzle is not rotated and the nozzle is moved radially outwardly from a position opposite the center of the workpiece while simultaneously (i) causing the etchant to impinge upon the workpiece and (ii) applying a voltage to the workpiece to thereby cause electrochemical spiral etching of the workpiece.

2. The etching apparatus of claim 1 further comprising a nozzle tube having an orifice and a face plate attached to the nozzle orifice, wherein the nozzle is contained in the face plate.

3. The etching apparatus of claim 2 wherein the face plate is the electrode.

4. The etching apparatus of claim 2 wherein there are a plurality of nozzles.

5. The etching apparatus of claim 4 wherein the nozzles are of varying size.

6. The etching apparatus of claim 5 wherein the nozzles of varying sizes include bigger nozzles and relatively smaller nozzles, wherein the bigger nozzles are near the center of the face plate while the smaller nozzles are near the edge of the face plate.

7. The etching apparatus of claim 1 wherein the electrode is a metallic screen that is interposed between the nozzle and a workpiece when a workpiece is present on the fixture.

8. The etching apparatus of claim 7 wherein the metallic screen electrode is adapted for being the same size as the workpiece when a workpiece is present on the fixture.

9. The etching apparatus of claim 1 having an etching rate, wherein the etching rate of the apparatus is controlled by means for controlling the rotational speed of the fixture and the rate of movement of the nozzle.

10. The etching apparatus of claim 1 wherein the fixture faces downwardly and the nozzle is oriented vertically upwardly.

11. The etching apparatus of claim 1 wherein the fixture faces upwardly and the nozzle is oriented vertically downwardly.

12. The etching apparatus of claim 1 wherein the fixture faces horizontally and the nozzle is oriented horizontally.

13. The etching apparatus of claim 1 wherein the means for radially moving the nozzle includes means for varying the rate of radial movement of the nozzle so that, in operation, the etching of the workpiece when present is varied across the workpiece so as to obtain a predetermined surface profile.

14. The etching apparatus of claim 1 wherein there are a plurality of nozzles.

15. The etching apparatus of claim 1 further comprising means for varying the voltage with radial movement of the nozzle so that, in operation, the etching of the workpiece when present is varied across the workpiece so as to obtain a predetermined surface profile.

16. A method of electrochemically etching a workpiece with an apparatus comprising a fixture for holding a workpiece, a nozzle for supplying an etchant and an electrode for applying a voltage to the workpiece, the method comprising the steps of:

rotating one of the workpiece and nozzle;

applying a voltage to the workpiece; and variably moving the nozzle radially outwardly from a position opposite the center of the workpiece while simultaneously causing the etchant to impinge upon the rotated workpiece so as to cause and vary the electrochemical etching of the workpiece while moving the nozzle to obtain a predetermined surface profile.

17. A method of electrochemically etching a workpiece with an apparatus comprising a fixture for holding a workpiece, a nozzle for supplying an etchant and an electrode for applying a voltage to the workpiece, the method comprising the steps of:

rotating one of the workpiece and nozzle;

applying a voltage to the workpiece; and moving the nozzle radially outwardly from a position opposite the center of the workpiece while simultaneously causing the etchant to impinge upon the rotated workpiece to thereby cause electrochemical etching of the workpiece, wherein the workpiece is spirally etched.

18. An electrochemical etching apparatus comprising:

a fixture for holding a workpiece;

a nozzle, adapted to be positioned opposite the fixture and facing the workpiece when present and adapted for impinging an etchant onto the workpiece;

means for rotating the nozzle;

means for radially moving the nozzle; and an electrode for applying a voltage to the workpiece;

wherein, in operation, the fixture is not rotated while the nozzle is rotated and the nozzle is moved radially outwardly from a position opposite the center of the workpiece while simultaneously (i) causing the etchant to impinge upon the workpiece and (ii) applying a voltage to the workpiece to thereby cause electrochemical spiral etching of the workpiece.

19. The etching apparatus of claim 18 having an etching rate, wherein the etching rate of the apparatus is controlled by means for controlling the rotational speed and the rate of movement of the nozzle.

20. The etching apparatus of claim 18 further comprising a nozzle tube having an orifice and a face plate attached to the nozzle orifice, wherein the nozzle is contained in the face plate.

21. The etching apparatus of claim 20 wherein there are a plurality of nozzles.

22. The etching apparatus of claim 20 wherein the face plate is the electrode.

23. The etching apparatus of claim 18 wherein the electrode is a metallic screen that is interposed between the nozzle and a workpiece when a workpiece is present on the fixture.

24. The etching apparatus of claim 23 wherein the metallic screen electrode is adapted for being the same size as the workpiece when a workpiece is present on the fixture.

25. The etching apparatus of claim 18 wherein the fixture faces downwardly and the nozzle is oriented vertically upwardly.

26. The etching apparatus of claim 18 wherein the fixture faces upwardly and the nozzle is oriented vertically downwardly.

27. The etching apparatus of claim 18 wherein the fixture faces horizontally and the nozzle is oriented horizontally.

28. The etching apparatus of claim 18 wherein the means for radially moving the nozzle includes means for varying the rate of radial movement of the nozzle so that, in operation, the etching of the workpiece when present is varied across the workpiece so as to obtain a predetermined surface profiles.

29. The etching apparatus of claim 18 wherein there are a plurality of nozzles.

30. The etching apparatus of claim 29 wherein the nozzles are of varying size.

31. The etching apparatus of claim 30 wherein the nozzles of varying sizes include bigger nozzles and smaller nozzles, wherein the bigger nozzles are near the center of the face plate while the smaller nozzles are near the edge of the face plate.

32. The etching apparatus of claim 18 further comprising means for varying the voltage with radial movement of the nozzle so that, in operation, the etching of the workpiece when present is varied across the workpiece so as to obtain a predetermined surface profile.

* * * * *